US008202141B2

(12) United States Patent
Le Borgne et al.

(10) Patent No.: US 8,202,141 B2
(45) Date of Patent: Jun. 19, 2012

(54) TOOL FOR MACHINING COMPOSITE MATERIAL PARTS

(75) Inventors: Didier Le Borgne, Bouaye (FR); Jean-Benoit Chalet, Notre-Dames des Landes (FR)

(73) Assignee: Airbus Operations SAS, Toulouse (FR)

( * ) Notice: Subject to any disclaimer, the term of this patent is extended or adjusted under 35 U.S.C. 154(b) by 701 days.

(21) Appl. No.: 12/091,127

(22) PCT Filed: Oct. 24, 2006

(86) PCT No.: PCT/EP2006/067699

§ 371 (c)(1),
(2), (4) Date: Oct. 9, 2008

(87) PCT Pub. No.: WO2007/048781

PCT Pub. Date: May 3, 2007

(65) Prior Publication Data

US 2009/0221218 A1 Sep. 3, 2009

(30) Foreign Application Priority Data

Oct. 27, 2005 (FR) ..... 05 53260

(51) Int. Cl.
*B24D 7/10* (2006.01)

(52) U.S. Cl. ..... 451/70; 451/461; 451/450

(58) Field of Classification Search ..... 451/41, 451/461, 548, 450, 488, 70
See application file for complete search history.

(56) References Cited

U.S. PATENT DOCUMENTS 5,000,630 A * 3/1991 Riley et al. ..... 408/228
5,137,098 A 8/1992 Raffaelli et al.
5,354,155 A 10/1994 Adams et al.
6,196,908 B1 * 3/2001 Adams ..... 451/461

* cited by examiner

*Primary Examiner* — Robert Rose
(74) *Attorney, Agent, or Firm* — Perman & Green, LLP

(57) ABSTRACT

A tool for machining composite material parts and a machining machine including such a tool. The tool has a substantially cylindrical main body. The main body includes a polishing part with a diameter $D_1$, with a main axis and an abrasive part with a diameter $D_2$, with $D_2 < D_1$, such abrasive part being centered on the main axis. The abrasive part includes, at its end at least one cutting element intended to enable penetrations of the tool into the composite material parts.

12 Claims, 2 Drawing Sheets

TOOL FOR MACHINING COMPOSITE MATERIAL PARTS

CROSS-REFERENCE TO RELATED APPLICATIONS

This application is the National Stage of International Application No. PCT/EP2006/067699, International Filing Date, Oct. 24, 2006 which designated the United States of America, and which international application was published under PCT Article 21(2) as WO Publication No. WO 2007/048781 A1 and which claims priority from French Application No. 0553260, filed Oct. 27, 2005 the disclosures of each being incorporated by reference in their entirety.

BACKGROUND

1. Field

The disclosed embodiments relate to a tool for machining composite material parts and a machining machine comprising such a tool.

2. Brief Description of Related Developments

Composite materials have become very important in many industrial fields. Their field of application, which mainly concerned aeronautics and space, initially, is now expanding and now concerns very different sectors such as the automobile, railway, or entertainment industries (sailboards, etc.).

In the industry of parts for aeronautics, machining is a critical method. It not only helps obtaining accurate dimensions on the manufactured parts, it also makes it possible to obtain complex parts from materials, which would otherwise be difficult to transform.

For composite materials, the trimming operation of a part is directly performed on the final surface treatment, using a machining tool making one or several passes in the thickness of such part, the number of required passes depending on the thickness.

However, it has been noted that the trimming of the composite material part can result in defects in the part, the final product thus obtained not reaching the expected mechanical properties. Such defects, which result from the raising of fibre folds, are also called "spalling". In the absence of rejection of the part during the quality control, such defects can lead to the breaking of the part during the utilisation.

A more or less rapid wear of such machining tools caused by the absence of checking of the depth of the pass in the thickness of the part, between two passes has also been noted. Now, such premature wear of the tool causes more frequent stoppages of the machining machine and the action of a skilled operator. The costs implied in the changing of the tool, as well as the lost in productivity related to the operator's action duration, are not compatible with the economic obligations of the industry of parts for aeronautics.

Besides, the machining tools of the prior art used for machining composite material parts do not make it possible to make holes or cavities in such parts.

The manufacturing of parts, by cutting in a large dimensioned plate, with such machining tools, thus requires to start from one edge of such plate to reach the first part to be cut. A machine cannot go directly to the starting point of the cutting of the part, since the latter is located by its coordinates in a positioning grid, which is that of the plate.

The cutting of additional material thus implied greatly increases the time required for cutting the parts from the plate and entails a premature wearing of the machining tool.

Finally, the mechanical machining of composite materials also requires more and more advanced cutting tools for greatly increasing the throughput of chips and thus reduce the time required for the trimming operations on a composite material part.

SUMMARY

The aspects of the disclosed embodiments generally provide a tool for machining composite material parts, having a simple design and operation procedure, which is economical and makes it possible to check the depth of the pass of such tool, so that it is constant from one pass to the other, while simultaneously making the pre-forming and the finishing of the part, while trimming.

In one aspect the disclosed embodiments provide a machining tool capable of simultaneously performing pre-forming and finishing operations by a direct penetration into the material of the part.

For this purpose, the disclosed embodiments relate to a tool for machining composite material parts, such tool having a substantially cylindrical main body.

According to the disclosed embodiments, the main body includes a polishing part having a diameter $D_1$, with a main axis and an abrasive part having a diameter $D_2$, with $D_2<D_1$, the abrasive part being centred on such main axis. Besides, the abrasive part includes, at its end at least one cutting element intended to enable the penetrations of the tool in said parts, such cutting element of the abrasive part being a recess in the shape of an inverted truncated cone.

In various particular embodiments of such machining tool, each one having its particular advantages and for which of many technical combinations are possible:

the tool has at least a central conduit opening onto the external surface of the abrasive part for the lubrication thereof.

Advantageously, the lubrication of the tool is provided by a conduit positioned at the centre of the main body of the tool and opening onto the end of the abrasive part, at the level of the cutting element.

the central conduit further being in fluid communication with at least one annex channel opening onto the external surface of said abrasive part.

Such annex channels are preferably distributed on several levels of the abrasive parts, in order to uniformly lubricate the external surface of the abrasive part. The lubricating fluids used are, for example, cutting oil or an emulsion.

the abrasive part includes abrasive particles having an average abrasive particle size between approximately 300 μm and 1000 μm, the polishing part includes abrasive particles having an average abrasive particle size between approximately 100 μm and 600 μm.

The size of the abrasive particle is typically determined by the biggest dimension of the abrasive particles. Of course, a particle size distribution exists around such average abrasive particle size. Nevertheless, it will also be possible to try and have a more important control of the particle size distribution, so that the polishing part thus determined gives a more uniform finishing of the composite material part.

the polishing part has voids between the abrasive particles.

Preferably, the average size of such voids is between 10 and 500 μm.

the polishing part includes at least one continuous or non-continuous surface area allowing the gripping of the tool.

The disclosed embodiments also relate to a machining machine for composite material parts including at least one tool holding device intended to receive a cutting tool.

According to the disclosed embodiments, such cutting tool is a tool such as previously described.

BRIEF DESCRIPTION OF THE DRAWINGS

The disclosed embodiments will be described in greater details while referring to the appended drawings, wherein.

DETAILED DESCRIPTION

Figure 1A:
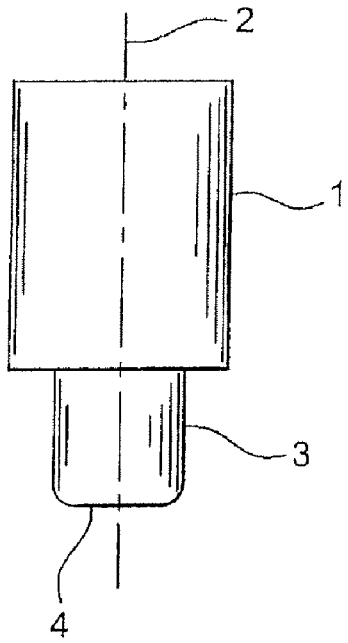
FIG. 1 is a schematic side view of a tool for machining composite material parts, as seen laterally (FIG. 1*a*) and in cross-section (FIG. 1*b*) according to an embodiment of the disclosed embodiments.
Figure 1B:
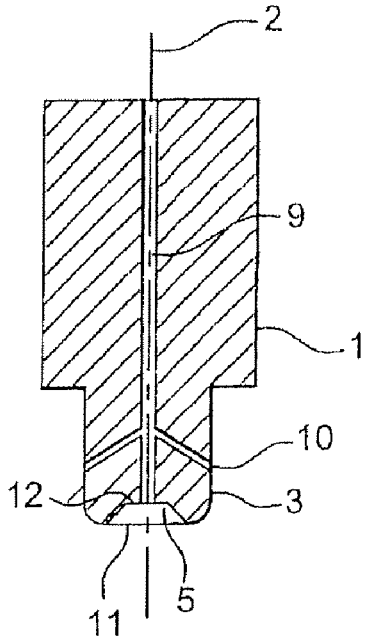

FIG. 1 shows a tool for machining composite material parts according to one particular embodiment of the disclosed embodiments. Such tool has a substantially cylindrical main body. Such main body includes on the one end, a polishing part 1 with a diameter $D_1$ with a main axis 2 and on the other hand, an abrasive part 3 with a diameter $D_2$, with $D_2<D_1$. The abrasive part 3 is centred on this main axis 2, so that the difference between the diameters of both parts $(D_2-D_1)/2$ defines the side finish working thickness of the tool.

The shoulder resulting from the difference in diameter between these two parts 1, 3 of the main body makes it possible to keep a constant depth of pass of the tool, whatever the thickness of the part to be trimmed.

Besides, the polishing 1 and abrasive 3 parts make it possible to simultaneously pre-form and finish the part without having to change the tool on the machining machine. The main body is a single piece. It is advantageously made of metal, for example, of steel.

The abrasive part 3 of the main body includes, at its end 4 at least a cutting element 5 intended to enable penetrations of the tool into the parts. Such cutting element 5 makes it possible to drill holes or cavities, for example, in the composite material parts.

Figure 2:
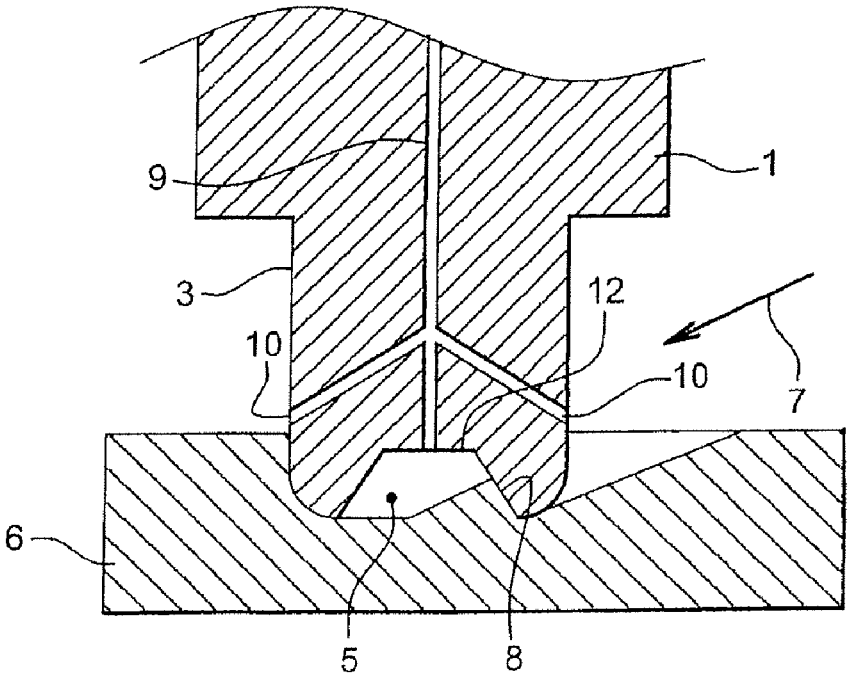
FIG. 2 is a partial cross-sectional view of the tool of FIG. 1 showing the abrasive part having penetrated into the material of a part.

The cutting tool 5 is made by a recess in the form of an inverted truncated cone positioned at the end of the abrasive part 3. FIG. 2 shows a cross-sectional view of such a tool having penetrated into the material of a part 6. The tool moves from right to left in the direction of the penetration shown by the arrow 7. The tool has a cutting edge 8 within the abrasive part, which works into the material.

The abrasive part 3 includes abrasive particles having an average abrasive particle size between approximately 300 μm and 1000 μm, and preferably between 400 μm and 850 μm.

Such abrasive particles are advantageously chosen in the group including cubic boron nitride, single crystal diamond or polycrystalline diamond, carbide and combinations of such elements.

In the case where abrasive particles of the abrasive part 3 are polycrystalline diamond, the deposition of these particles can be executed by electroplating, by deposition of brazed metal or deposition of brazed polycrystalline diamond or through the deposition of diamond layers thanks to the chemical vapour deposition technique (CVD—"Chemical vapor deposition"). Such deposition techniques which are known by the persons skilled in the art will not be described herein.

The polishing part 1 having the diameter $D_2$ includes abrasive particles having an average abrasive particle size between approximately 100 μm and 600 μm, and preferably between 250 and 500 μm.

The abrasive particles for the polishing part 1 can be chosen in the group including diamond, aluminium oxide, zirconium oxide and combinations of such elements.

In the case where the abrasive particles of the polishing part 1 are polycrystalline diamond, the deposition of such particles can be made by deposition of diamond by electroplating.

The polishing part 1 preferably includes at least one continuous or non-continuous surface area, which is not shown, making it possible for an operator to grip the tool in order to mount it on, or to remove it from the tool holder of a machining machine.

The tool also has a portion placed behind the main body of the tool, the shape of which makes it possible to insert the tool on a tool holder. Such portion can be made in various ways, so as to be mounted on all types of connections known to the person skilled in the art. In this case, such portion includes a rectified cylindrical handle so that the tool can advantageously be mounted into connecting handles of the SA, clamped, or sintered type.

The diameter $D_1$ of the polishing part 1 is preferably between 10 and 32 mm, ±10%, with the diameter $D_2$ of the abrasive part 3 being smaller than the diameter $D_1$. For example, the diameter $D_2$ is between 6 and 28 mm, ±10%.

For a tool having such diameters for the abrasive 3 and polishing 1 parts, the truncated cone 5 has a base 11 with a diameter between 4 and 24 mm ±10% and an apex 12 with a diameter between 2 and 20 mm ±10%. Such geometry of the cutting element determines the maximum penetration angle of the tool.

The tool can include a central conduit 9 opening onto the external surface of the abrasive part 3, which makes it possible to liquid-cool a tool from the centre. Preferably, the conduit 9 opens onto the end 4 of the abrasive part 3 at the level of the cutting element 5 for the lubrication thereof. The central conduit 9 also has outlets 10 on the external surface of the abrasive part 3.

Figure 3A:
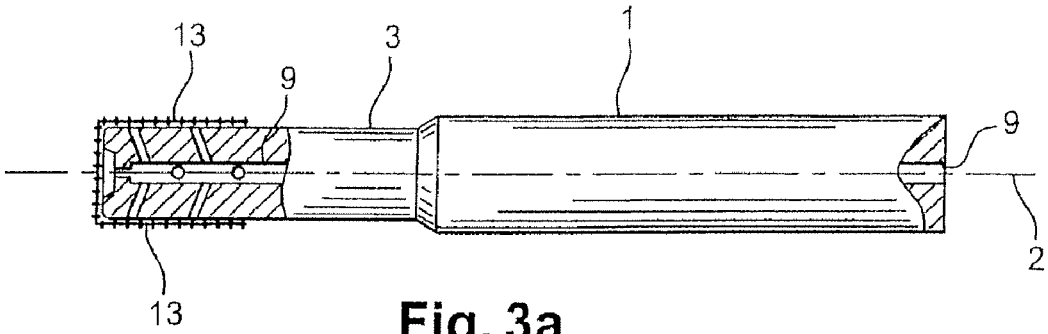
FIG. 3 schematically shows a tool for machining composite material parts, as seen from the side with the ends in cross-section (FIG. 3*a*) according to another embodiment.
FIG. 3*b* is a cross-sectional enlarged view of the end of the abrasive part of the machining tool.
Figure 3B:
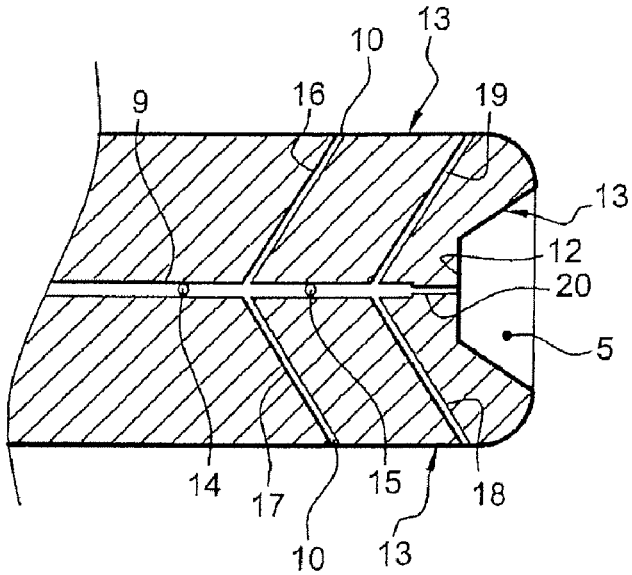

FIG. 3 shows a tool for machining composite material parts in another embodiment. These structure elements of FIG. 3 having the same references as those in FIG. 1 show the same objects. The abrasive part 3 of the main body includes at its end 4 a cutting element 5 intended to enable penetrations of the tool into the parts. A portion 13 of the external surface of the abrasive part 3 is coated with diamond. The central conduit 9 is connected to a set of annex spraying channels 14-20 distributed at several levels and opening onto the outlets 10. Such annex channels 14-20 are preferably distributed in the body of the abrasive part 3 so as to uniformly spray the external surface of the tool and more particularly the diamond-coated portion 13. The diameter of the central conduit 9 is greater than that of the annex channels 14-20, so as to obtain an always sufficient spraying pressure, constant in the annex spraying channel 14-20. The end of the central conduct 9 on the polishing part 1 side is advantageously connected to a pressurised lubricant fluid supplying system. Such pressure is preferably above 10 bars in order to secure the flowing of the lubricant fluid throughout the tool holder/tool assembly.

Such liquid-cooling from the centre of the tool advantageously makes it possible to increase the working life of the tool, while reducing the scaling noted in the devices of the prior art and the cutting velocity of such tool for a preserved machining quality.

The gains, shown as a (tool cost)/(productivity ratio), obtained with the tool for machining composite material parts according to the disclosed embodiments with respect to a technology implementing a cutting tool with polycrystalline diamond edges (PCD) are of the order of 95 to 98%.

The invention claimed is:

1. A tool for machining composite material parts, said tool having a substantially cylindrical main body comprising:

a polishing part with a diameter D1, having a main axis, an abrasive part with a diameter D2, with D2<D1, said abrasive part being centered on said main axis, wherein said abrasive part includes, at its end at least a cutting element intended to enable penetrations of said tool into said parts, said cutting element of said abrasive part being a recess made in the end of said abrasive part and defining a cutting edge, said recess having the shape of an inverted truncated conical cavity, said main body further comprising at least a central conduit opening onto the end of said abrasive part at the level of the cutting element for the lubrication thereof.

2. The tool according to claim 1, wherein said central conduit is further in fluid communication with at least an annex channel opening onto the external surface of said abrasive part.

3. The tool according to claim 1, wherein said abrasive part includes abrasive particles having an average abrasive particle size between about 300 μm and 1000 μm.

4. The tool according to claim 1, wherein said abrasive part includes abrasive particles which are chosen in the group including cubic boron nitride, polycrystalline diamond, carbide, and combinations of such elements.

5. The tool according to claim 1, wherein said polishing part includes abrasive particles having an average abrasive particle size between about 100 μm and 600 μm.

6. The tool according to claim 5, wherein said polishing part has voids between the abrasive particles.

7. The tool according to claim 1, wherein said polishing part includes abrasive particles which are chosen from the group comprising diamond, aluminium oxide, zirconium oxide and combinations of these elements.

8. The tool according to claim 1, wherein said polishing part includes at least a continuous or non-continuous surface area allowing the gripping of said tool.

9. The tool according to claim 1, further comprising a portion positioned behind the main body, the shape of which allows the insertion of said tool on a tool holder.

10. The tool according to claim 1, wherein a diameter D1 of said polishing part is between 10 and 32 mm±10% and diameter D2 of said abrasive part is between 6 and 28 mm,±10%.

11. The tool according to claim 1, wherein said truncated cone has a base with a diameter between 4 and 24 mm±10% and an apex with a diameter between 2 and 20 mm±10%.

12. A machine for machining composite material parts comprising at least a tool holding device intended to receive a cutting tool, wherein said cutting tool is a tool according to claim 1.

* * * * *

UNITED STATES PATENT AND TRADEMARK OFFICE

CERTIFICATE OF CORRECTION

PATENT NO. : 8,202,141 B2
APPLICATION NO. : 12/091127
DATED : June 19, 2012
INVENTOR(S) : Didier Le Borgne et al.

It is certified that error appears in the above-identified patent and that said Letters Patent is hereby corrected as shown below:

Cover Page, Bibliographic Data Sheet, Column 1, (75) Inventors: delete "Notre-Dames", and insert -- Notre-Dame --, therefor.

Signed and Sealed this
Thirty-first Day of July, 2012

David J. Kappos

David J. Kappos
*Director of the United States Patent and Trademark Office*